US007921609B2

(12) United States Patent
Kordelin

(10) Patent No.: US 7,921,609 B2
(45) Date of Patent: Apr. 12, 2011

(54) ROOM ARRANGEMENT, SHIP, BUILDING AND METHOD FOR CONSTRUCTING A ROOM ARRANGEMENT

(75) Inventor: Tapio Kordelin, Turku (FI)

(73) Assignees: Neapo Oy, Uusikaupunki (FI); STX Finland Oy, Turku (FI)

( * ) Notice: Subject to any disclaimer, the term of this patent is extended or adjusted under 35 U.S.C. 154(b) by 417 days.

(21) Appl. No.: 11/795,950

(22) PCT Filed: Jan. 30, 2006

(86) PCT No.: PCT/FI2006/000022

§ 371 (c)(1),
(2), (4) Date: Jul. 25, 2007

(87) PCT Pub. No.: WO2006/079682

PCT Pub. Date: Aug. 3, 2006

(65) Prior Publication Data

US 2008/0163808 A1 Jul. 10, 2008

(30) Foreign Application Priority Data

Jan. 28, 2005 (FI) ..... 20050095

(51) Int. Cl.
*E04B 1/348* (2006.01)
*E04B 1/38* (2006.01)
*B63B 29/02* (2006.01)

(52) U.S. Cl. ..... 52/79.9; 52/236.3; 52/236.7; 52/236.6; 52/236.9; 52/745.2; 114/71; 114/77 R

(58) Field of Classification Search ..... 52/79.1, 52/79.7, 79.9, 234, 236.3, 79.13, 236.7, 272, 52/281, 582.1, 266, 271, 79.5, 106, 236.9, 52/745.17, 745.2, 783.17, 793.1; 114/65 R, 114/71, 77 R, 77 A, 78; 29/DIG. 42
See application file for complete search history.

(56) References Cited

U.S. PATENT DOCUMENTS

| | | | | |
|---|---|---|---|---|
| 2,368,441 | A | 1/1945 | Bedford | |
| 2,575,758 | A * | 11/1951 | Herd | 52/405.4 |
| 2,873,008 | A * | 2/1959 | Ashman | 52/579 |
| 3,051,277 | A * | 8/1962 | Day, Jr. | 52/262 |
| 3,500,596 | A | 3/1970 | Anderson | |
| 3,832,811 | A * | 9/1974 | Briel, Jr. | 52/69 |
| 3,971,172 | A * | 7/1976 | Gentil | 52/28 |
| 3,992,828 | A * | 11/1976 | Ohe | 52/69 |

(Continued)

FOREIGN PATENT DOCUMENTS

DE 2118108 4/1971

(Continued)

OTHER PUBLICATIONS

International Search Report (PCT/F12006/000022); dated May 30, 2006.

*Primary Examiner* — Robert J Canfield
(74) *Attorney, Agent, or Firm* — Nixon & Vanderhye P.C.

(57) ABSTRACT

Room arrangements include at least two superposed prefabricated load-bearing room units. The room units have a ceiling, a floor and at least two walls that are made at least mainly of cellular board. Ships, buildings and methods for constructing a room arrangement are also provided, especially the construction of multi-storey rooms, for example, cabin compartments in ships or block of flats without middle decks or intermediate floors.

33 Claims, 5 Drawing Sheets

U.S. PATENT DOCUMENTS

| | | | | | |
|---|---|---|---|---|---|
| 4,003,182 | A | * | 1/1977 | Wokas | 52/745.02 |
| 4,045,937 | A | * | 9/1977 | Stucky | 52/745.03 |
| 4,443,992 | A | * | 4/1984 | Shechter | 52/745.02 |
| 4,505,082 | A | | 3/1985 | Schmitz | |
| 4,513,545 | A | * | 4/1985 | Hopkins, Jr. | 52/79.1 |
| 4,528,928 | A | * | 7/1985 | Virta et al. | 114/189 |
| 4,592,175 | A | * | 6/1986 | Werner | 52/79.9 |
| 4,599,829 | A | * | 7/1986 | DiMartino, Sr. | 52/79.7 |
| 4,722,154 | A | * | 2/1988 | Virta et al. | 52/79.1 |
| 4,784,076 | A | * | 11/1988 | Carlsson | 114/71 |
| 4,833,841 | A | * | 5/1989 | Ellington, III | 52/79.1 |
| 4,854,094 | A | * | 8/1989 | Clark | 52/79.1 |
| 4,959,933 | A | * | 10/1990 | Lappi | 52/79.7 |
| 5,233,808 | A | * | 8/1993 | Salmenmaki et al. | 52/745.02 |
| 5,353,557 | A | * | 10/1994 | Lerner et al. | 52/106 |
| 5,755,063 | A | * | 5/1998 | Ohnishi et al. | 52/79.8 |
| 6,016,636 | A | * | 1/2000 | Caputo | 52/745.2 |
| 6,085,485 | A | | 7/2000 | Murdock | |
| 6,155,016 | A | * | 12/2000 | Wacker et al. | 52/588.1 |
| 6,260,496 | B1 | * | 7/2001 | Chevalier | 114/71 |
| 6,698,147 | B2 | * | 3/2004 | Bergman | 52/234 |
| 2004/0103596 | A1 | * | 6/2004 | Don et al. | 52/79.1 |
| 2005/0210762 | A1 | * | 9/2005 | Broberg | 52/79.1 |
| 2005/0262778 | A1 | * | 12/2005 | Allen et al. | 52/79.1 |
| 2006/0150534 | A1 | | 7/2006 | Window | |
| 2006/0196132 | A1 | * | 9/2006 | Ruano | 52/236.3 |
| 2007/0271857 | A1 | * | 11/2007 | Heather et al. | 52/79.9 |
| 2008/0286552 | A1 | * | 11/2008 | Kordelin et al. | 428/223 |
| 2010/0077675 | A1 | * | 4/2010 | Seavy | 52/106 |

FOREIGN PATENT DOCUMENTS

| | | | | |
|---|---|---|---|---|
| DE | 42 37 326 | A1 | * | 11/1992 |
| DE | 299 19 825 | U1 | | 3/2000 |
| EP | 0 546 847 | A1 | * | 6/1993 |
| EP | 1 099 621 | A1 | | 5/2001 |
| EP | 1266821 | | | 5/2002 |
| FR | 2273123 | | | 5/1974 |
| JP | 54-138298 | | * | 10/1979 |
| JP | 5-33396 | | * | 2/1993 |
| JP | 5-179710 | | * | 7/1993 |
| JP | 6-49906 | | * | 2/1994 |
| NL | 8602691 | | * | 5/1988 |
| WO | 94/05879 | | * | 3/1994 |
| WO | 95/32345 | | | 11/1995 |
| WO | 03047960 | | | 6/2003 |
| WO | 03080427 | | | 10/2003 |
| WO | 2004/041633 | | | 5/2004 |
| WO | WO 2004/051017 | | | 6/2004 |
| WO | 2006/079682 | A1 | * | 8/2006 |
| WO | 2007-054608 | A1 | * | 5/2007 |

* cited by examiner

ROOM ARRANGEMENT, SHIP, BUILDING AND METHOD FOR CONSTRUCTING A ROOM ARRANGEMENT

This application is the US national phase of international application PCT/FI2006/000022 filed 30 Jan. 2006 which designated the U.S. and claims benefit of FI 20050095, dated 28 Jan. 2005, the entire content of which is hereby incorporated by reference.

TECHNICAL FIELD OF THE INVENTION

The object of the invention is a room arrangement, ship, building and method for constructing a room arrangement according to the preambles of the independent claims presented below. The invention relates especially to a new manner of constructing multi-storey rooms, ship cabin compartments or block of flats, for example.

PRIOR ART

It is known to bring ship cabins as prefabricated cabin modules to a shipyard, where the cabin modules are installed into a ship. In ships, the cabin modules are installed on some load-bearing base, such as a bottom, intermediate decks or a main deck of the ship. Usually, there are no floors in the prefabricated cabins to be installed into ships, since the deck on which the cabin module is typically installed, forms a frame for the cabin floor. Even though room units are prefabricated, there are still various work phases to be completed at the installation location itself. Prefabricated room units can also be used in house construction. Also in this case, a module is installed on a load-bearing base.

One drawback of the known prior art is, that a load-bearing base, onto which base the prefabricated room unit is installed, such as an intermediate deck of a ship or a floor structure of a building, is needed under each prefabricated room unit. Decks that serve as load-bearing bases in ships are usually of 5-7 mm thick steel, and together with their supporting structures they are about 350-500 mm high structures, wherefore they are heavy and take remarkably space. Also load-bearing floors, which are typically used in residential buildings between the storeys, are thick. They also take space, and are extremely heavy structures. Also load-bearing vertical structures, for example load-bearing walls and columns take space and increase the weight of a ship or a building. Continuous load-bearing bases of prior art, such as a ship deck or a structure between storeys of a residential building, usually conduct heat and sound quite well. Prior art solutions include a steel frame or a side of a ship or an outer wall of a building, that are separate from the room units.

Patent publication WO 2004/041633 describes a solution, where two prefabricated cabins are supported and attached in vertical direction directly to each other, so that the lower cabin carries the majority of the weight of the upper cabin. In the solution according to the publication, the cabins are installed into the ship in a transverse direction parallel to the decks. The lower cabin storey is installed first, and floorless cabins of the second cabin storey are transferred upon the first layer from the side. In the solution of the publication, the vertical wall elements of the room units have been installed on the floor elements. Thus, the floor element has to carry the weight of the vertical walls to be installed on it. In the publication, seams, and thus also acoustic and thermal bridges, are formed in vertical walls at the location of the floor elements. The publication in question does not provide a solution for enabling connecting of more than two room units to each other in vertical direction so that the lower room units would sustain the gravity caused by the upper room units. The publication does not describe a functional solution for attaching cabin modules to each other so that acoustic or refractory insulation in a vertical or side direction would be solved at the same time.

In order to solve the disadvantages of the prior art, solutions have been suggested, but it has not been possible to eliminate heavily structured ship decks, for example. It is difficult to come up with a solution for acoustic and heat insulation of heavy hull structures, especially with strictly limited use of space. Satisfying solutions for attaching room modules to each other have not been presented.

THE AIM OF THE INVENTION AND BRIEF DESCRIPTION

It is an aim of the present invention to reduce or even eliminate the above-mentioned problems of prior art.

It is an aim of the present invention especially to provide a solution, with which high self-bearing structures can be rapidly, economically and simply constructed of prefabricated room units.

One object of the invention is to achieve a room arrangement, where several prefabricated room units can be connected to each other in vertical direction so that no other load-bearing structure, such as a ship deck or a frame of a residential building, is needed between the room units.

One object of the invention is to provide a room arrangement, where the room units carry both themselves and the room units above them.

One object of the invention is to provide a ship, in which multi-storey cabin compartments carry themselves.

One object of the invention is to provide a building, in which multi-storey room arrangements carry themselves.

One object of the invention is to provide a room arrangement, the load-bearing frame of which is formed of room units, especially of the wall structures of the room units that have been installed upon each other.

One object of the invention is to provide multi-storey room arrangements for ships and buildings, which are fire safe, have good soundproofing properties and are economic to construct.

One aim of the invention is to provide a connecting profile and a connection, by means of which room units can be easily attached to each other in a firm, but flexible manner.

One object of the invention is to provide a self-bearing room arrangement comprising several prefabricated room units, the room units of which arrangement can be attached to each other in a firm, but flexible manner.

One object of the invention is to provide a prefabricated self-bearing room unit and a ship and a building comprising them, in which ship and building a wall of a prefabricated room unit forms an outer wall of the deck construction of a ship or an outer wall of a building.

One object of the invention is to provide a room arrangement, at the location of which there is no need for separate outer wall structure in a ship or a building.

In order to realise for instance the objects mentioned above the room arrangement, ship, building and method according to the invention are characterised by what is presented in the characterising parts of the enclosed independent claims.

The embodiments and advantages mentioned in this text relate, when applicable, to the room arrangement, ship, building as well as to the method according to the invention, even though it is not always specifically mentioned.

A typical room arrangement according to the invention comprises at least two load-bearing prefabricated room units that are arranged superposed and have a ceiling, a floor and at least two walls that are made at least mainly of cellular board. All walls, typically two side walls and two end walls, are preferably ready in the prefabricated room unit. The walls are typically provided with necessary doors and possibly windows. Typically, the walls, floor and ceiling have also a necessary number of openings for cords, pipes etc.

In this context, the room unit refers to a self-bearing unit which is used in construction and which comprises a ceiling, a floor and walls. Typically, the room unit is to be moved in one piece and to be installed to its location in one piece. The room unit may be a prefabricated ship cabin, for example.

In this context, the room arrangement refers to a structure that is formed of several room units, which have been attached together, superposed apartments of block of flats or a ship cabin compartment, for example.

In this context, prefabricated refers to the fact that the ceiling, floor and walls of a room unit have been connected together already prior to its installation to its location in a ship or a building. Interior decoration of a prefabricated room, such as furniture, carpets, wall papers, bathroom decoration, and heating, plumbing, ventilation and electrical installations, has typically also been worked as readily as possible before the room unit is transferred to its installation location.

In this context, the cellular board refers to a structure known as such, formed of two substantially parallel surface plates and of a core arranged between them. Typically, also the core is plate-like material, but its shape has been arranged to differ from the direction of the surface plates, for example by forming folds and grooves between the folds to the plate material. Typically, the core comprises several adjacent and parallel straight shapes having usually mainly the length of the whole cellular board. In this context, such longitudinal direction of the shapes of the cellular board core is called a core direction. Cellular board resists extremely well bending in transversal direction in relation to the direction of the cores. Typically, the core of the cellular board according to the invention has been firmly attached to the surface plates. Typically, the surface plates and the core have been welded together by laser welding, for example. Typically, the surface plates and the core of the cellular board according to the invention are made of metal, such as steel, for example stainless steel, or aluminium, but also other materials can be used. Thickness of the surface plates and the core, material, and shape of the core can be sized to be appropriate for each situation. By means of a cellular board structure, it is possible to achieve a structure that is considerably lighter, more rigid and has better bending resistance than a continuous plate structure. Shape of the core has a great influence on the rigidity and strength of the cellular board. For example, a core made of steel can have the shape of a wavelike bent plate where wave crests are typically welded to the surface plates. The cores can also be arranged in V-shape, for example, or formed of plates substantially perpendicular to the surface plates, that is, plates that are arranged in I-shape. The core can consist of a plate bent in the form of a honeycomb. It is also possible to use beams that have the shape of a pipe, and are circular or other shape in cross-section, as a core.

In this context, the load-bearing structure refers to a structure, which carries its own weight as well as the weight above it. A typical load-bearing structure forms a support frame for the entire structure, which support frame carries forces directed to the structure, and provides a sufficient functional rigidity.

It has now been surprisingly discovered that by using cellular board know as such as a main structure for the floor, ceiling and walls of the room units, it is possible to easily achieve an extremely rigid, self-bearing and light structure. By using cellular boards according to the invention, the room unit can be made into a self-bearing structure without any specific beam structures or the like.

It has now further been surprisingly discovered, that superposed and/or adjacent arrangements for room formed of room units according to the invention may themselves form a self-bearing structure. The floor, ceiling and walls of a room unit, which are mainly made of cellular board, are easily arranged so firm that such a structure carries both itself and several room units to be installed on it. The room arrangement is made especially firm when the walls of the superposed room units are precisely on top of each other. The room units, which are attached to each other, can form a ship cabin compartment or a block of flats, for example, and serve themselves as the load-bearing hull structure of a building. The room arrangement according to the invention can have, for example, exactly or at least 1, 2, 3, 4, 5, 6, 7, 8, 9, 10, 15, 20, 25, 30, 40 or 50 room units on top of each other. The room arrangement according to the invention may also have, for example, 2-10, 2-15, 2-20, 2-30, 2-40, 2-50, 3-10, 3-15, 3-20, 3-30, 3-40, 3-50, 4-10, 4-15, 4-20, 4-30, 4-40, 4-50, 5-10, 5-15, 5-20, 5-30, 5-40 or 5-50 room units on top of each other.

One advantage of the invention is that only one load-bearing hull plane, such as a ship bottom or deck, or a load-bearing base floor of a building, on which the room units can be installed, is needed. Thereby, even all intermediate decks can be excluded from ships, at least at the location of the arrangements according to the invention. Similarly, load-bearing floor levels above the base floor can be excluded from buildings. The need for material required in hull structures in ships is significantly reduced, it is possible to considerably reduce the weight of a ship, maybe even 10% or even more. Similarly, in house construction, frame structures of a building may be lightened. The height of a ship or a building is reduced, or more cabins or rooms of the same height fit in the same height. Thus, it is possible to make the ship or building construction more economic and faster than before.

One advantage of the invention is that the need for construction work at a shipyard is reduced. Thus, more and more cabin preparing work can be carried out in better conditions than in a shipyard, whereby the quality and productivity of work can be improved. At the same time, construction of a ship becomes faster and faster.

One advantage of the invention is that less cabin finishing work of the room units is needed at the installation location, for example cleaning. It is even possible to prepare a room arrangement with an interior made completely ready already at the factory. For example, a cabin module can be fabricated at a factory where its doors are locked after finishing and cleaning. The cabin module is transported to a shipyard, where it is installed into a ship totally from outside, and the doors will be opened only when all dirty installation work is finished.

One advantage of the invention is that a completely readily prefabricated room unit can be stored even outdoors and even in frosty weather because it is closed. It is possible to install heating into the room unit for the time of storage, or to use during storage a heating device that has possibly been installed into the room unit. This way the furniture and rugs, for example, of the room unit maintain in good condition.

One advantage of the invention is that due to the floor, the prefabricated room units can be more and more readily-made.

One advantage of the invention is that acoustic and refractory insulation of the room units according to the invention is easily made. Acoustic and thermal bridges are easily cut in both vertical and horizontal directions between each room units. A separating structure of class A according to the international Solas qualification in a ship can be achieved in horizontal level with the structures according to the invention. A fire classification of class E can be simply achieved for the buildings according to the invention.

Due to its layer structure, for example the walls, ceilings or floors of the spaces with structures of steel cellular boards can be built as fire separating whenever necessary. Thanks to the invention, fire compartmentation of buildings and vessels is thus facilitated or simplified.

In an embodiment of the invention, the room unit comprises a load-bearing wall made at least mainly of cellular board, which wall divides the room above the floor of the room unit so that there will be a substantial distance of floor surface and space above it on both sides of the wall. Thus, a first part of the floor is intended to be the floor of the interior of the room unit, and a second part of the floor to be the floor of the exterior of the room unit, for example a balcony or a corridor floor. A substantial distance of floor surface means, for example, at least 0.5 m, at least 1 m, at least 1.5 m, at least 2 m, 0.5 m-1 m, 0.5-1.5 m, 0.5-2 m or 1-2 m as counted from said wall dividing the floor. There can be more than one room dividing walls. For example, one room unit may be prefabricated with a balcony or a balcony floor on one side, and with a corridor space or an engineering and utility services room or a floor for them on the other side. A door leading from a ship cabin to a corridor or to a balcony has typically been arranged into the wall dividing the room.

The room unit floor, which is intended to be the floor of a balcony or a corridor or of other exterior space, can be made as a self-bearing protruding part without supporting structures. Typically, the core direction of the cellular board has thus been arranged mainly perpendicular compared to the direction of the wall dividing said room. Thus, for example, the part of cellular board serving as the balcony floor does not require supporting beams or other specific load-bearing structures, such as walls supporting it from below. The direction of the cells in the walls of a room unit is typically mainly vertical for achieving maximal vertical strength. Directions of the cells may also vary in some parts of the walls, floor or ceiling.

In one embodiment of the invention a floor of one room unit consists of one continuous cellular board structure. Thus, a simple and especially sturdy structure is achieved. Such a floor cellular board can be manufactured in many different forms, but the floor of a room unit is typically longitudinal in its form, at least mainly rectangular. The shorter side of such a rectangular forming the floor of a room unit has a length, that is the width of the room unit, which varies typically between 1-5 m or between 1.5-4 m or 2-3 metres. The length of the longer side of such rectangular, that is the length of the room unit, varies typically between 3-15 m, or between 4-12 m, 5-10 m, 5-12 m, 6-10 m, 6-12 m or 6-8 m. The height of one room unit is typically such, that it suits for human residential use, typically 2-3 m.

In one embodiment of the invention, the horizontal elements of the room units, i.e. the ceiling or floor elements, are attached so that there will be no horizontal floor or ceiling element between two superposed vertical wall elements. In other words, the ceiling and/or the floor of a room unit have thus been attached to the vertical sides of the load-bearing walls. Therefore, the ceiling and floor elements can be connected to the interior surfaces of the vertical wall elements by bolting or welding, for example. Thus, the floor element does not have to carry the weight of the room units above it. With this solution, acoustic and thermal bridges will not be formed in the vertical walls at the location of the floor element.

In one embodiment of the invention, two or more room units are connected against each other substantially at the same horizontal level, so that the shorter sides of mainly rectangular floor cellular boards of said room units are against each other and attached to each other, and the longer sides are set as each others extensions forming one continuous long side. The floor cellular boards of the two connected room units together form a floor structure, the longer side of which is twice as long as the longer side of the floor of one room unit. For example, when installed into a ship, the floor cellular boards of the two room units connected in said manner, may form a floor structure, which extends from the first ship edge to the second ship edge, that is from one shipside to another shipside. Respectively, two, three or more room units can be arranged next to each other so that the long sides of their floor cellular boards are against each other and attached to each other. A floor structure, which may extend from the first ship edge to the second edge, is thus formed. The floor cellular boards of the room units being arranged substantially at the same horizontal level next to each other or successively, may this way replace the entire ship deck or part of the deck.

A shipside or an outer wall of a building may directly be formed of the outer wall of the room units. The cellular boards of the outer walls of the adjacent room units are connected to each other by welding, for example. Strips may also be attached on seams by welding or gluing, for example.

At least those structures of a room unit that are intended to be outer surfaces, for example a balcony floor and an outer surface of the outer wall, may be fabricated of stainless or acid-proof steel plate, or they can be coated with the same. This way resistance to corrosion is improved. Advantageously, at least the outer surfaces of cellular board or floor cellular board, that is the surface plate of the side exposed to outdoor air, for example, are stainless or acid-proof steel. When the cells are made of stainless or acid-proof steel, they are maintenance-free and last significantly longer than other solutions.

Means for attaching insulation material can be attached to the surface plate of the cellular board intended to be the outer surface of a room unit. For example, spikes, in which an insulation material plate can be placed, may be welded to this surface plate. For example, in a building according to the invention, for example a plastering or other coating may be arranged on the insulation material plate. This way the outer wall is made as desired in regard to looks and properties, such as weather proofness, for example.

In one embodiment of the invention, insulation material, such as blown wool, may be arranged inside the cellular board that forms the wall, floor or ceiling of a room unit, in a space between its core and the surface plates. Thus, the heat and sound insulation capacity is improved. The cellular board structure may be even totally filled with insulation material.

In one embodiment of the invention at least two load-bearing room units with a cellular board structure have been connected to each other in a vertical direction by means of first fastening means. This means that they have been firmly connected to each other, so that there is no load-bearing floor level, such as a ship deck.

In an embodiment of the invention superposed room units are similar at least in their external dimensions. In that case, the superposed room units may be installed in alignment so that the lower edge of the walls of the upper room unit settles against the upper edges of the walls of the lower room unit. Thus, the load-bearing walls with cellular board structure are in alignment, and a structure with a good load-bearing capacity in vertical direction is achieved.

In an embodiment of the invention the first fastening means comprise a connecting profile having a first form that fits the upper edge of the wall of the lower room unit, and a second form that fits the lower edge of the wall of the upper room unit, which walls are to be installed in alignment, as well as an element connecting the first and the second form. Forms that fit walls, such as a U-shaped profile, are easy to manufacture so that the connection will be firm but, at the same time, such that the walls are easily attached thereto.

In one embodiment of the invention at least two said room units have been connected to each other in a vertical direction by means of second fastening means. This way even adjacent high towers formed of room units are made firm.

In one embodiment of the invention the second fastening means comprise a connecting profile having forms that fit the upper edges and/or lower edges of the walls of the room units to be set adjacent to each other, as well as an element connecting these forms. Such forms that fit walls, such as a U-shaped profile, are easy to manufacture so that the connection will be firm, but flexible, if necessary. At the same time, said forms are easily made so that the walls of the room units are easily attached to a connecting profile. For example, said U-shaped profile can be arranged slightly opening towards the ends of branches of the U-shape.

The above-mentioned connecting profiles can be made of some suitable material, such as steel, so that they are slightly flexible. This way even high room arrangements can achieve better resistance to vibration and bending. In ships, for example, the hull can bend several centimeters in high waves. In that case, main part of the stress caused by bending can be carried by the connections between the room units according to the invention. The above-mentioned connecting profiles, that is the first and the second fastening means can easily be manufactured as the one and the same piece, for example by welding several connecting profiles together. Thus, installation is facilitated and the connection becomes durable. A connecting profile according to the invention can be made of steel having a thickness of 2-4 mm, for example, and a length of approximately one room unit, that is 5-12 m, for example.

A typical connecting profile according to the invention is intended for connecting firmly two or several room units to each other. The connecting profile comprises

- two downwards opening first forms for the upper edges of the walls of two lower room units, and
- two upwards opening second forms for the lower edges of the walls of two upper room units, as well as
- an element connecting the first and the second forms.

The connection between the room units according to the invention further comprises the above-mentioned connecting profile according to the invention, as well as the walls made of cellular board and connected to the connecting profile. In addition, the connection between the room units according to the invention comprises one or more insulating plates, such as an insulating mat, a ceramic mat, for example. The insulating plate or mat has typically been arranged between the connecting profile and the lower and the upper walls to be connected with the connecting profile, inside the first and the second forms. This insulating plate may consist of several separate pieces.

A connection between the room units according to an embodiment is used for connecting four room units together. In that case, the connection comprises

- two lower walls of the room unit made of cellular board,
- two upper walls of the room unit made of cellular board, and
- a connecting profile comprising two downwards opening first forms at a distance from each other in horizontal direction, and two upwards opening second forms at a distance from each other in horizontal direction, as well as an element connecting the first and the second forms.

Furthermore, this embodiment further one or more first insulating plates, which have been arranged between the connecting profile and the lower and the upper walls to be connected with the connecting profile, inside the first and the second forms.

In an embodiment of the invention, the connecting profile further comprises an upwards opening third form that has been arranged between said two first forms. A second insulating plate has typically been installed inside the third form. Typically, the second insulating plate is of mineral wool plate or the like, which has been arranged mainly in parallel with the plane of the walls of the room units connected to the connecting profile. The lower edge of the second insulating plate has been arranged inside the third form.

In a typical method for constructing a room arrangement according to the invention, one or more load-bearing prefabricated room units are installed at the installation location. Thus, the room units have at least a ceiling, a floor and at least two walls, which are made at least mainly of cellular board. The installation location may be a ship or a block of flats, for example. The method comprises at least the following steps:

- Building a load-bearing first storey of the room arrangement by installing at least one load-bearing prefabricated room unit on a load-bearing plane of the installation location. The load-bearing plane of the installation location refers, for example, to a ship bottom or main deck, or to a load-bearing base floor of a building, which carries the room arrangement of a required size being constructed.
- Building a second storey of the room arrangement by installing at least one load-bearing prefabricated room unit on the load-bearing first storey. The room units according to the invention carry themselves and do not need specific supporting structures.
- Connecting superposed room units to each other by a connection according to the invention. The connection comprises a connecting profile having suitable forms, to which the upper edge of the wall of the lower room unit and the lower edge of the upper room unit in alignment with it are installed and attached.

An embodiment of the method according to the invention further comprises:

- Building a desired number of load-bearing storeys to the room arrangement by installing at least one load-bearing prefabricated room unit on the previous load-bearing storey.
- Connecting each storey always to the previous one by connecting the superposed room units to each other by said connection according to the invention.

An embodiment of the method according to the invention further comprises:

- Building two or more room units next to each other to the load-bearing first storey of the room arrangement.
- There will now be two lower and two upper walls of the room unit to be connected at the connecting point of the next storey. New storeys are now attached to each other with the connecting profile according to the invention having suitable forms for four walls of the room unit.

When using the methods according to the invention for constructing buildings or ships, savings in time and costs are achieved.

BRIEF DESCRIPTION OF THE FIGURES

The invention is described in more detail below with reference to the enclosed schematic drawing, in which.

DETAILED DESCRIPTION OF THE EXAMPLES OF THE FIGURES

Figure 1:
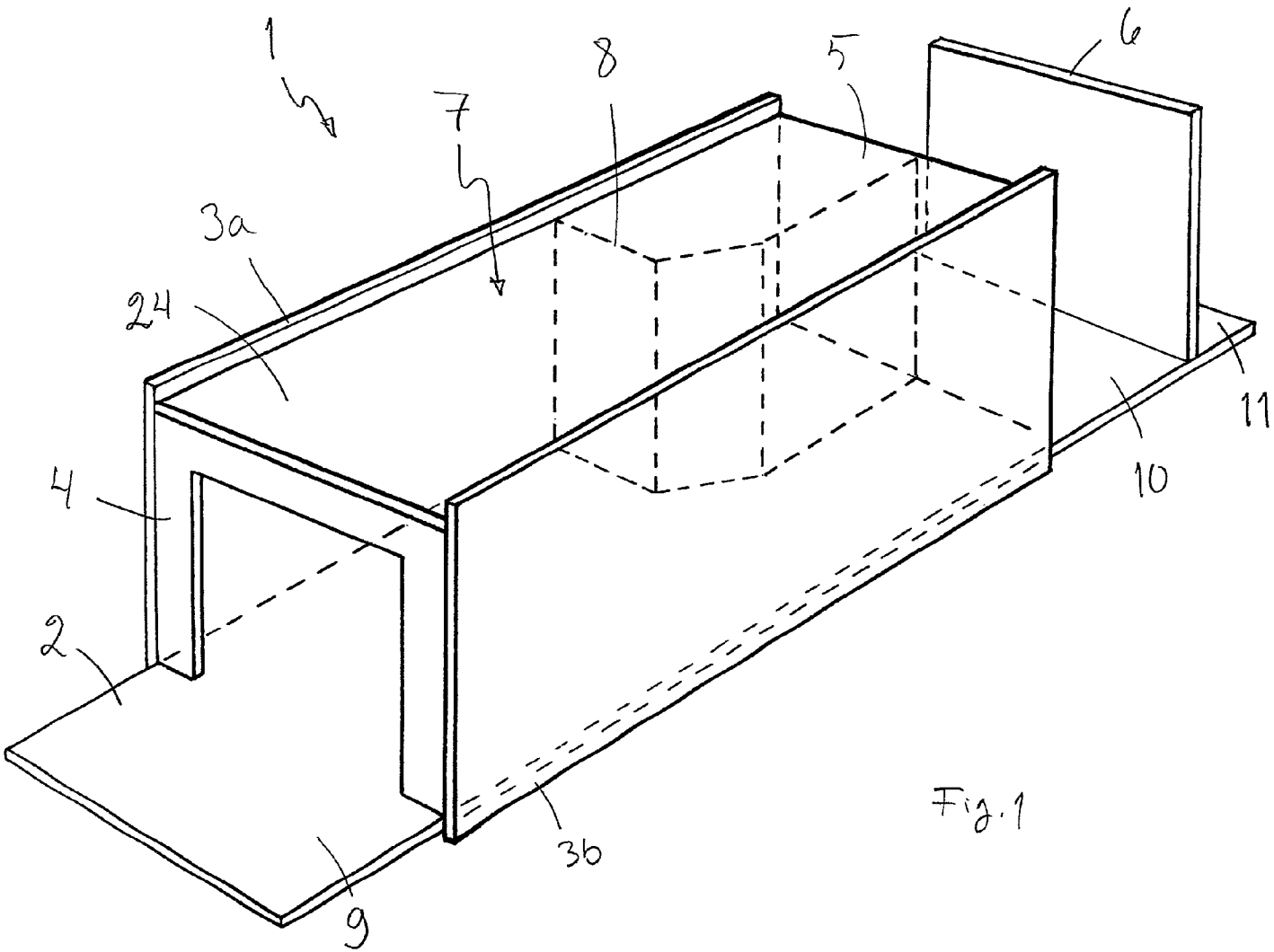
FIG. 1 shows a room unit according to the invention.

For the sake of clarity, some corresponding parts have the same reference numerals. Further for the sake of clarity, some dimensions in the figures are distorted.

FIG. 1 shows a room unit 1 according to the invention. The room unit 1 has a floor plate 2, ceiling 24, sidewall panels 3*a* and 3*b*, outer wall panels 4, corridor wall panels 5 and another corridor wall panel 6, which are made of cellular board of steel. The wall panels 3, 4 and 5 and the ceiling 24 limit the space above the floor panel 2 to a room 7, such as a ship cabin. Inside the room, a bathroom 8 is shown in broken lines. The floor panel 2 extends to both sides of the outer wall 4 and the corridor walls 5 and 6. External parts of the floor of the room 7 form a balcony floor 9, corridor floor 10 and engineering and utility services room floor 11. The balcony floor 9 and the outer wall panel 4 have been coated by stainless steel for improving their weather resistance. The floor 2 of the room unit 1 in FIG. 1 consists of one continuous cellular board structure.

Figure 7:
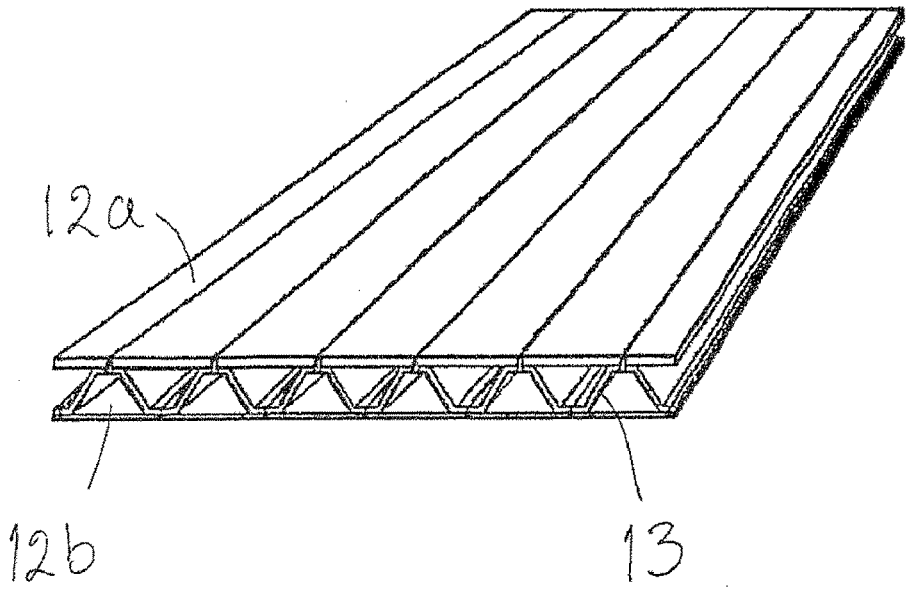
FIG. 7 shows a cellular board structure.

The principal of a typical cellular board structure is shown in FIG. 7. The cellular board comprises the surface plates 12*a* and 12*b*. Bent longitudinal steel material has been attached between the surface plates to form a core 13. The core 13 has been welded, for example laser welded, to the surface plates 12*a* and 12*b*. Cell direction of the cellular board is the direction of said bendings. The surface plates of the cellular board in FIG. 7 are formed of several laser welded pieces in the core direction, but the surface plates 12*a* and 12*b* could also be formed of one piece with the size of the entire cellular board.

Figure 2:
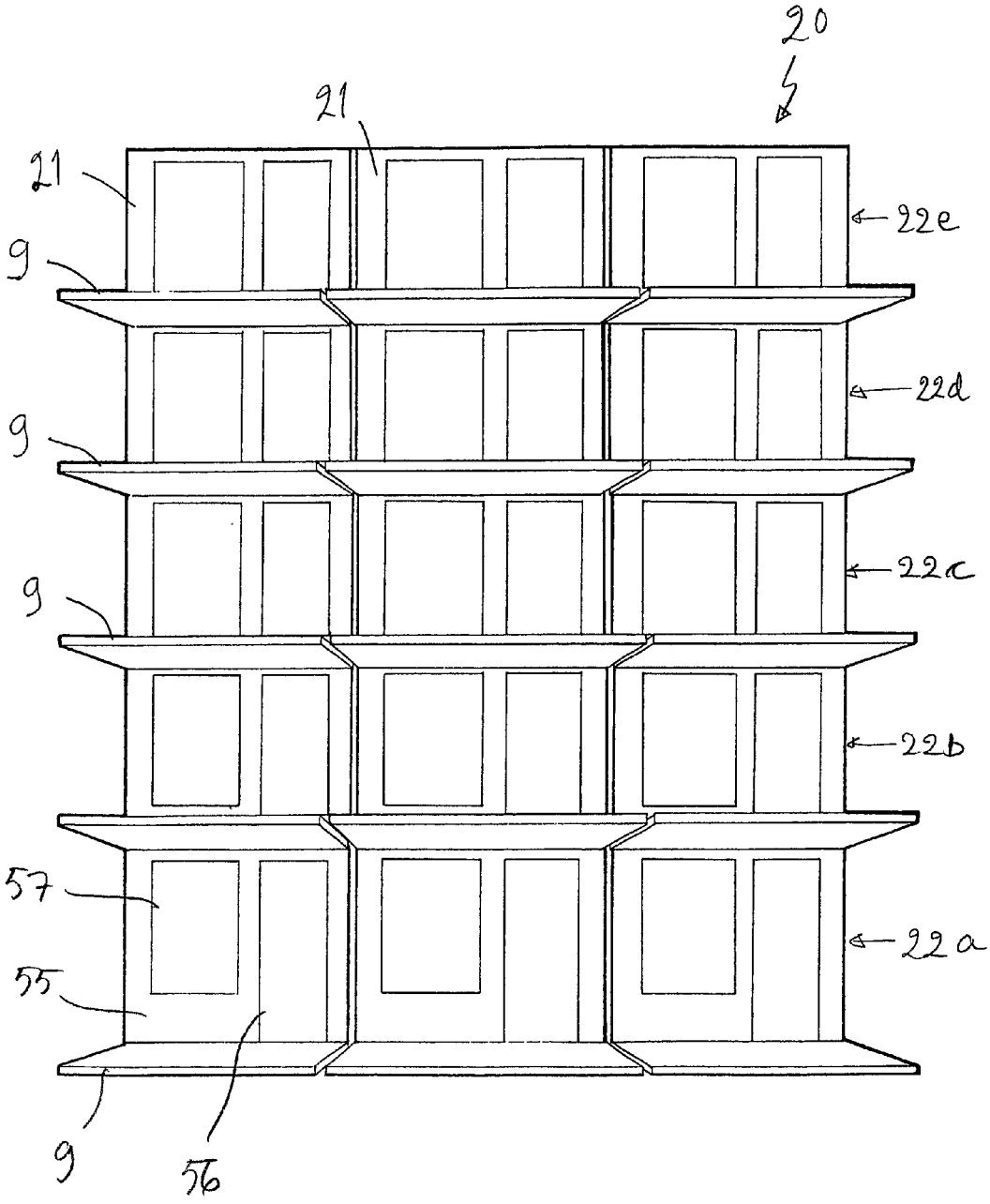
FIG. 2 shows a room arrangement according to the invention.

FIG. 2 shows the room arrangement 20 according to the invention, where room units 21 according to the invention have been firmly attached together having five on top of each other and three next to each other. The first storey 22*a* has been at first attached directly to the ship deck or to the load-bearing base plate of a building. The second storey 22*b* is then constructed directly and only onto the first storey 22*a*. The third storey 22*c*, for one, is built onto the second storey 22*b*, the fourth storey 22*d* onto the third storey 22*c*, and the fifth storey 22*e* onto the fourth storey 22*d*. Due to its cellular board structure, the room arrangement 20 is a self-bearing structure. In case the room arrangement 20 is a block of flats, the roofing deck or the roof covering of a building could be installed on it. In case the room arrangement 20 is a ship cabin compartment, a weather deck or the like, for example, could be installed on it. Each room unit 21 has a balcony 9, parapets of which are not shown in Figures. Each room unit 21 has a door 56 and a window 57 formed into the outer wall 55.

In FIG. 2, the room units 21 of the room arrangement 20 are at least almost identical in their configuration. In that case, the superposed room units have been connected in alignment so that the lower edge of the walls of the upper room unit always settles against the upper edges of the walls of the lower room unit. Connecting of the room units to each other will be described in more detail in FIGS. 3-6.

Figure 3:
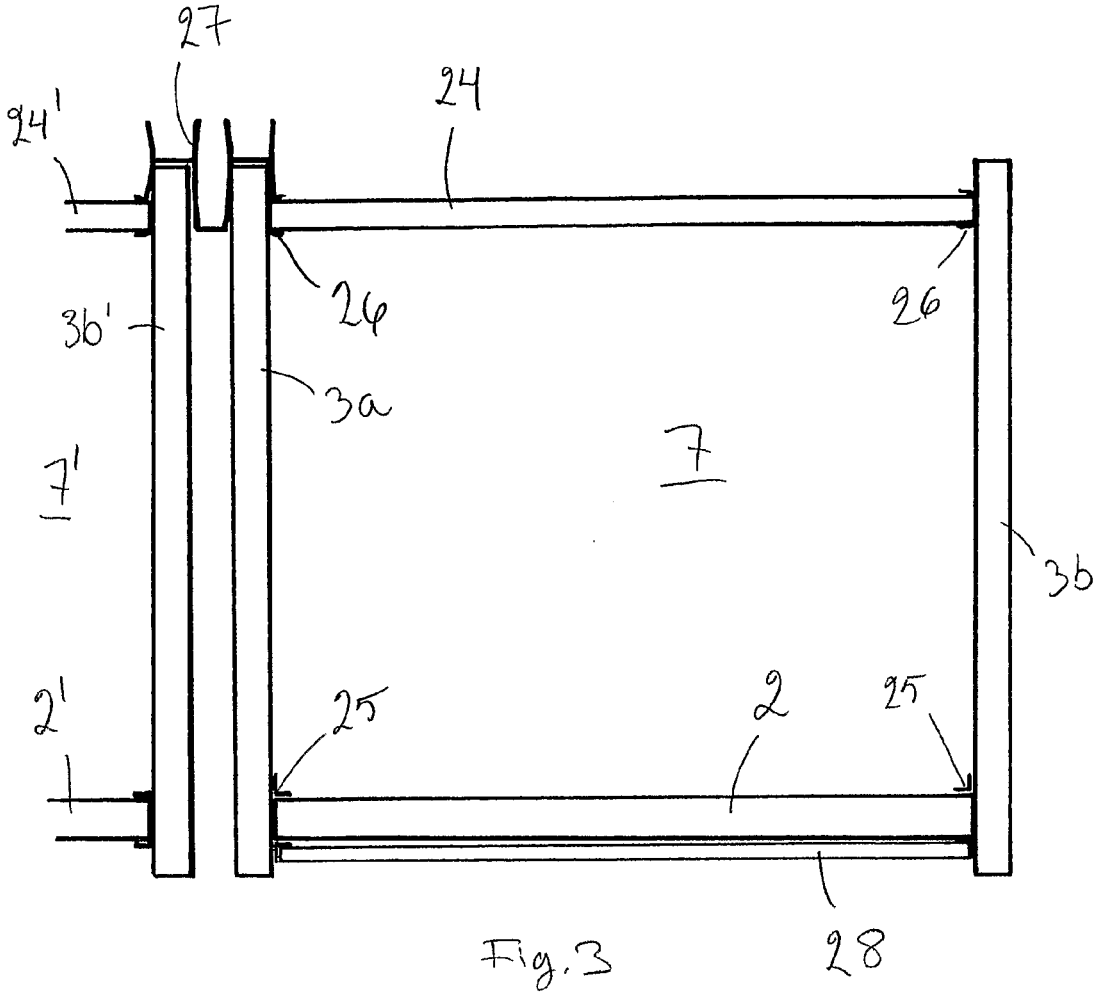
FIG. 3 shows a section of a part of a room arrangement according to the invention.

FIG. 3 shows a cross-section of some part of the room arrangement 20 of FIG. 2. It shows the cross-section of the room 7 limited by the ceiling 24, the side walls 3*a* and 3*b*, as well as by the floor 2. Next to it, there is a side wall 3*b*', ceiling 24' and floor 2' of another room unit. Figure shows how the floor 2 has been attached to the walls 3*a* and 3*b* by welding an L-strip 25 to both the walls 3*a* and 3*b* and to the floor 2. The ceiling 24 has been attached to the walls 3*a* and 3*b* via the U-profile 26. These attachment manners are not a specific object of the invention, and they can be varied according to need. The main idea is that the attachments between different cellular boards are durable enough for the room unit to hold its load-bearing structure together. In FIG. 3, to secure the best vertical load-bearing, the ceiling and floor elements have been attached so that there will be no horizontal floor or ceiling element between two superposed vertical wall elements. In other words, the ceiling 24 and the floor 3 have been attached to the vertical sides of the load-bearing walls 3*a* and 3*b*. Insulating material, such as a mineral wool plate 28, has been attached under the floor 2 for sound and heat insulation. A connecting profile 27 according to the invention has been installed on the adjacent side walls 3*a* and 3*b*. One connecting profile 27 according to the invention is shown enlarged in FIG. 4.

Figure 4:
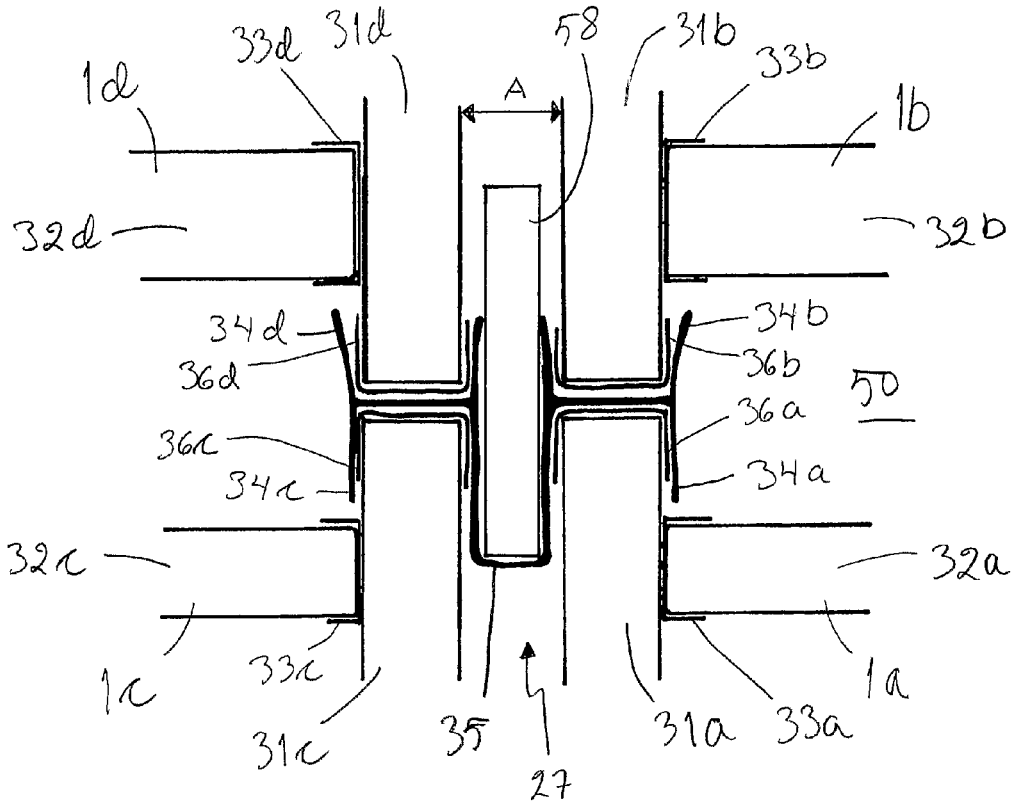
FIG. 4 shows a connection according to the invention.

FIG. 4 shows the connecting point of four room units 1*a*, 1*b*, 1*c* and 1*d*. The upper parts 31*a* and 31*c* as well as the ceilings 32*a* and 32*c* can be seen of the room units 1*a* and 1*c*. The lower parts 31*b* and 31*d* as well as the floors 32*b* and 32*d* can be seen of the room units 1*b* and 1*d*. In addition, the U-profiles 33*a*-*d* can be seen, by means of which the floors and ceilings have been attached to the walls. In the connecting profile 27 a U-profile has been formed for each of the four walls 31 intended to be connected together by the connecting profile. These fastening means 34*a*-*d* have been connected with the U-profile 35. The distance A between the adjacent room units is determined by means of the U-profile 35. A can be 25-50 mm, for example, whereas the thickness of the walls 31*a*-*d* can be 30-60 mm, for example. An insulating plate 58 can be placed into the U-profile 35. A ceramic mat 36*a*-36*d*, or some other suitable thin heat and sound insulating material, has been installed between the ends of the U-profiles 34 and the walls 31. Empty spaces left between the floors and the ceilings, for example a space 50, which is left between the floor 32*b* of the upper room unit and the ceiling 32*a* of the lower room unit, can be utilized by installing therein engineering, such as piping and wiring, etc.

Figure 5:
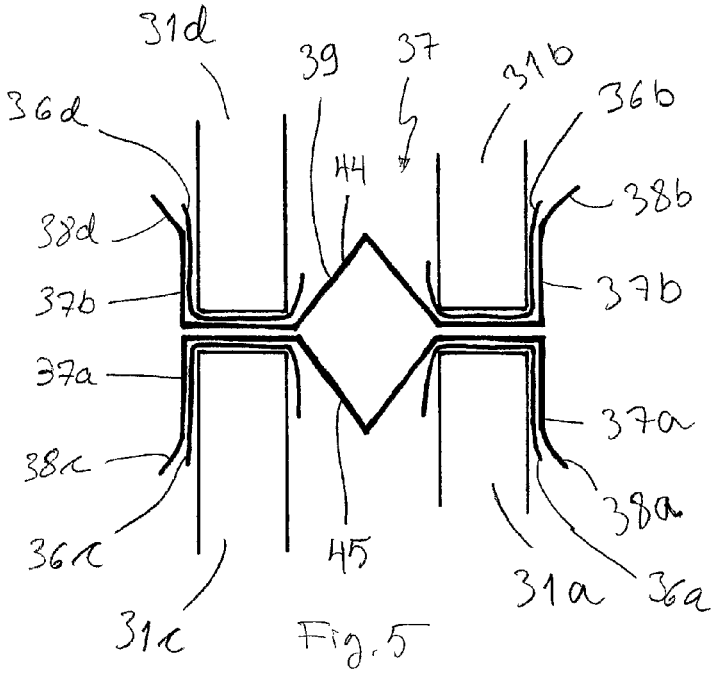
FIG. 5 shows another connection according to the invention.

FIG. 5 shows an alternative embodiment for the connecting profile 27 of FIG. 4. The connecting profile 37 consists of two elements 37*a* and 37*b*, which can be attached to each other prior to the installation by welding, for example. Forms intended for the walls 31*a*-*d* of the connecting profile 37 differ in their shape from those of FIG. 4. FIG. 5 shows how the ends 38*a*-*d* of said forms 37*a* and 37*b* for the walls have been bent away from the form 37*a* and 37*b*. The wall 31 is thus more easily installed into the connecting profile 37. Easy installation is important, sometimes room modules are installed in rather narrow and uncomfortable spaces. Ceramic mat 36*a*-*d* has been placed between the forms 37*a* and 37*b* and the ends of the walls 31*a*-*d*. In the middle of the connecting profile 37, there is an element 39 that serves as an enforcement for the connection. During installation, a diagonal lower surface 45 of the element 39 guides the lower walls 31*a* and

31*c* to their proper locations, that is to the bottom of the forms 37*a*. During installation, a diagonal upper surface 44 of the element 39 guides the upper walls 31*b* and 31*d* to their proper locations, that is to the bottom of the forms 37*b*. This way the form and the size 39 of the element determines the distance of the adjacent walls of the connection, the walls 31*a* and 31*c*, for example, from each other.

Figure 6:
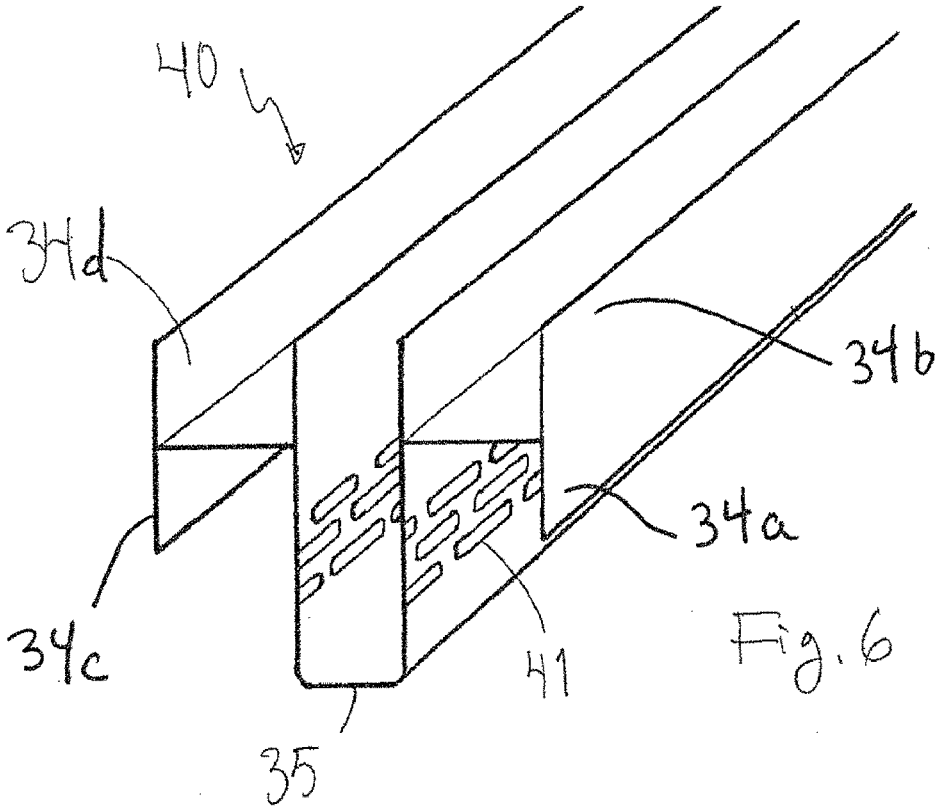
FIG. 6 shows a connecting profile according to the invention.

FIG. 6 shows one alternative for the connecting profile 40 according to the invention. The connecting profile 40 has the forms of the U-profile 34 for installing and attaching the walls, as well as the form of the U-profile 35 for determining the distance between the adjacent room units. An insulating plate can be placed into the U-profile 35. Openings 41 have been formed in overlapping rows into the vertical parts of the U-profile 35 for the distance of the entire connecting profile. The purpose of these so-called "thermo-openings" is to slow down the heat and sound conduction in a vertical direction in a metal connecting profile 40.

Only one advantageous embodiment of the invention is shown in the figures. Figures do not separately show matters that are irrelevant in view of the main idea of the invention, known as such or obvious as such for a man skilled in the art. It is apparent to the man skilled in the art that the invention is not limited exclusively to the examples described above, but that the invention can vary within the scope of the claims presented below. The dependent claims present some possible embodiments of the invention, and they are not to be considered to restrict the scope of protection of the invention as such.

The invention claimed is:

1. Room arrangement comprising at least two superposed prefabricated load-bearing room units which have been attached together, each room unit having a ceiling, a floor and at least two walls, the ceiling, the floor and the walls of the room unit being connected together, wherein the ceiling, floor and at least two walls are at least mainly made of cellular board formed of two substantially parallel surface plates and of a core firmly attached to and arranged between the surface plates, wherein the surface plates and the core of the cellular board are made of metal.

2. Room arrangement according to claim 1, wherein at least one of the room units comprises at least one wall which is mainly made of cellular board, and which divides the space above the floor of the room unit so that a first and a second side of said wall have a substantial distance of space above the floor.

3. Room arrangement according to claim 2, wherein the cellular board of the floor is arranged so that cells thereof extend from the first side to the second side of the at least one wall dividing the space above the floor.

4. Room arrangement according to claim 2, further comprising a balcony of the room unit or a corridor space of the room arrangement arranged onto an end part of the floor.

5. Room arrangement according to claim 2, wherein the wall dividing the space above the floor includes a door.

6. Room arrangement according to claim 1, wherein a floor of one room unit consists of one continuous cellular board structure.

7. Room arrangement according to claim 1, wherein a cellular board of at least one wall is arranged as an outer wall of the room arrangement.

8. Room arrangement according to claim 7, wherein an outer surface of the cellular board of the outer wall and/or the floor is made of stainless steel or covered by a stainless steel plate.

9. Room arrangement according to claim 1, wherein at least two said room units are connected to each other in a vertical direction by first fastening means.

10. Room arrangement according to claim 9, wherein superposed room units are connected in alignment so that a lower edge of the walls of an upper room unit settles at an upper edge of the walls of a lower room unit.

11. Room arrangement according to claim 1, wherein at least one of a ceiling and a floor of the room unit is attached to sides of load-bearing walls.

12. Room arrangement according to claim 10, wherein the first fastening means comprise a connecting profile having a first form that fits the upper edge of the wall of the lower room unit and a second form that fits the lower edge of the wall of the upper room unit, which walls are installed in alignment, and an element connecting the first and the second form.

13. Room arrangement according to claim 9, wherein the at least two said room units are connected to each other in a horizontal direction by second fastening means.

14. Room arrangement according to claim 13, wherein the second fastening means comprise a connecting profile having a first and a second form that fit upper edges of the walls of the room units adjacent to each other, and an element connecting the first and the second form.

15. Room arrangement according to claim 13, wherein the second fastening means comprise a connecting profile having a first and a second form that fit lower edges of the walls of the room units adjacent to each other, and an element connecting the first and the second form.

16. Room arrangement according to claim 13, wherein the first and the second fastening means are the one and the same.

17. Room arrangement according to claim 9, wherein the first fastening means comprise a connecting profile for connecting the room units, wherein the connecting profile comprises:

two downwards opening first forms for upper edges of the walls of two lower room units, two upwards opening second forms for lower edges of the walls of two upper room units, and an element connecting the first and the second forms.

18. Room arrangement according to claim 1, including two superposed room units and a connection therebetween comprising:

a wall of the lower room unit made of cellular board, a wall of the upper room unit made of cellular board, and a connecting profile for connecting the room units, wherein the connecting profile comprises, a) a first form inside of which an upper edge of the wall of the lower room unit is arranged and attached, b) a second form inside of which a lower edge of the wall of the upper room unit is arranged and attached, and c) an element connecting the first and the second forms.

19. Room arrangement according to claim 18, which further comprises:

two lower walls of the room unit made of cellular board, two upper walls of the room unit made of cellular board, and a connecting profile comprising a) two downwards opening first forms in a horizontal direction at a distance from each other, wherein upper edges of the walls of the lower room units are arranged and attached inside the first forms, b) two upwards opening second forms in a horizontal direction at a distance from each other, wherein lower edges of the walls of the upper room units are arranged and attached inside the second forms, wherein c) the element connects the first and the second forms.

20. Room arrangement according to claim 18, which further comprises one or more insulation plates arranged between the connecting profile and the lower and the upper walls connected by the connecting profile inside the first and second forms.

21. Room arrangement according to claim 19, wherein the connecting profile further comprises:

d) an upwards opening third form arranged between said two first forms, and e) a second insulating plate arranged mainly in parallel with a plane of the walls of the room units connected to the connecting profile, wherein a lower edge of the second insulating plate is arranged inside the third form.

22. Room arrangement according to claim 1, wherein said ceiling, floor and at least two walls are at least mainly made of cellular board formed of two substantially parallel surface plates and a core arranged therebetween.

23. Room arrangement according to claim 1, wherein the room arrangement comprising several prefabricated room units is a self-bearing structure.

24. Room arrangement according to claim 1, wherein a load-bearing frame of the room arrangement is formed of wall structures of superposed room units.

25. A ship comprising the room arrangement according to claim 1.

26. Ship according to claim 25, wherein the room arrangement forms a self-bearing ship cabin compartment.

27. Ship according to claim 25, wherein a load-bearing frame of the room arrangement is formed of wall structures of superposed room units.

28. A building comprising the room arrangement according to claim 1.

29. Building according to claim 28, wherein the room arrangement forms a self-bearing block of flats.

30. Building according to claim 28, wherein a load-bearing frame of the room arrangement is formed of wall structures of superposed room units.

31. Method for constructing a room arrangement at an installation location of at least two prefabricated load-bearing room units, each of which has at least a ceiling, a floor and at least two walls made at least mainly of cellular board, the method comprising at least the following steps:

building a load-bearing first storey of the room arrangement by installing at least one load-bearing prefabricated room unit on a load-bearing plane of the installation location, building a second storey of the room arrangement by installing at least one load-bearing prefabricated room unit on the load-bearing first storey, connecting the walls of the superposed room units, the walls being made of cellular board, to each other by a connecting profile which comprises a) a first form inside of which an upper edge of the wall of the lower room unit is arranged and attached, b) a second form inside of which a lower edge of the wall of the upper room unit is arranged and attached, and c) an element connecting the first and the second forms.

32. Method according to claim 31, which further comprises:

building a desired number of load-bearing storeys to the room arrangement by installing load-bearing prefabricated room units on a previously built load-bearing storey, and connecting the superposed room units to each other by a connecting profile which comprises a) a first form inside of which an upper edge of the wall of the lower room unit is arranged and attached, b) a second form inside of which a lower edge of the wall of the upper room unit is arranged and attached, and c) an element connecting the first and the second forms.

33. Method according to claim 31, which further comprises;

building two or more room units adjacent to each other on the load-bearing first storey of the room arrangement, attaching the storeys to each other by connecting two lower walls of a room unit, the two lower walls being made of cellular board, and two upper walls of the room unit, the two upper walls being made of cellular board, by means of a connecting profile, which comprises, a) two downwards opening first forms in a horizontal direction at a distance from each other, wherein upper edges of the walls of the lower room units are arranged and attached inside the two first forms, b) two upwards opening second forms in a horizontal direction at a distance from each other, wherein lower edges of the walls of the upper room units are arranged and attached inside the two second forms, and c) an element connecting the first and the second forms.

* * * * *